US008118448B2

(12) United States Patent
Chen

(10) Patent No.: US 8,118,448 B2
(45) Date of Patent: Feb. 21, 2012

(54) REFLECTOR COMPONENT FOR A LED LAMP

(76) Inventor: Hui Yu Chen, Taichung County (TW)

( * ) Notice: Subject to any disclaimer, the term of this patent is extended or adjusted under 35 U.S.C. 154(b) by 313 days.

(21) Appl. No.: 12/412,603

(22) Filed: Mar. 27, 2009

(65) Prior Publication Data

US 2010/0182783 A1 Jul. 22, 2010

(30) Foreign Application Priority Data

Jan. 17, 2009 (TW) ..... 098101793 A

(51) Int. Cl.
*F21V 1/00* (2006.01)

(52) U.S. Cl. ..... 362/235; 362/236; 362/238; 362/240; 362/241; 362/243; 362/245; 362/247; 362/249.02; 362/310; 362/343

(58) Field of Classification Search ..... 362/235, 362/609, 327–329, 514, 516, 518–520, 522, 362/215, 217.05–217.07, 236, 238, 240, 362/241, 243, 245, 247, 249.02, 296.01, 362/297, 299, 300, 308–310, 341, 343, 346–350, 362/360, 361

See application file for complete search history.

(56) References Cited

U.S. PATENT DOCUMENTS

| | | | | |
|---|---|---|---|---|
| 1,955,598 | A * | 4/1934 | Lamblin-Parent | 362/309 |
| 3,700,883 | A * | 10/1972 | Donohue et al. | 362/518 |
| 5,678,921 | A * | 10/1997 | Kish et al. | 362/205 |
| 6,414,801 | B1 * | 7/2002 | Roller | 359/726 |
| 6,840,654 | B2 * | 1/2005 | Guerrieri et al. | 362/241 |
| 2003/0053314 | A1 * | 3/2003 | Summerford et al. | 362/342 |
| 2006/0083006 | A1 * | 4/2006 | Poel | 362/346 |
| 2008/0180967 | A1 * | 7/2008 | Totani et al. | 362/518 |
| 2008/0219000 | A1 * | 9/2008 | Fan | 362/241 |

* cited by examiner

*Primary Examiner* — Anabel Ton
*Assistant Examiner* — Danielle Allen
(74) *Attorney, Agent, or Firm* — Kirschstein, et al.

(57) ABSTRACT

A reflector component is provided for a light emitting diode (LED) lamp that includes a plurality of spaced-apart LED light sources. The reflector component includes a bottom wall having two side edges extending along a longitudinal direction. The bottom wall is formed with a plurality of spaced-apart through holes, each of which permits a respective one of the LED light sources to extend therethrough. The reflector component further includes two side walls extending respectively and upwardly from and along the two side edges of the bottom wall. Each of the side walls has a reflecting surface that faces toward the other of the side walls and that extends upwardly and inclinedly relative to the bottom wall such that a distance between the reflecting surfaces increases in a direction away from the bottom wall.

15 Claims, 12 Drawing Sheets

REFLECTOR COMPONENT FOR A LED LAMP

CROSS-REFERENCE TO RELATED APPLICATION

This application claims priority of Taiwanese Application No. 098101793, filed on Jan. 17, 2009.

BACKGROUND OF THE INVENTION

1. Field of the Invention

The invention relates to a reflector component, more particularly to a reflector component for a LED lamp.

2. Description of the Related Art

A conventional light emitting diode (LED) lamp has a light emitting angle of approximately 120°. If a reflector is not in use, light projected by the LED lamp is scattered. In addition, the LED lamp requires a focusing lens for long distance illumination and localized illumination (spot illumination). However, the LED lamp with the focusing lens is not suited for large region illumination and mid-range (0.5-1 m) illumination.

SUMMARY OF THE INVENTION

Therefore, the object of the present invention is to provide a reflector component for a light emitting diode (LED) lamp such that the LED lamp is suitable for large region illumination.

According to the present invention, there is provided a reflector component for a LED lamp, wherein the LED lamp includes a plurality of LED light sources spaced apart from each other along a longitudinal direction. The reflector component includes a bottom wall having two side edges extending along the longitudinal direction. The bottom wall is formed with a plurality of through holes that are spaced apart from each other along the longitudinal direction. Each of the through holes permits a respective one of the LED light sources to extend therethrough. The reflector component further includes two side walls extending respectively and upwardly from and along the two side edges of the bottom wall. Each of the side walls has a reflecting surface that faces toward the other of the side walls and that extends upwardly and inclinedly relative to the bottom wall such that a distance between the reflecting surfaces increases in a direction away from the bottom wall.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
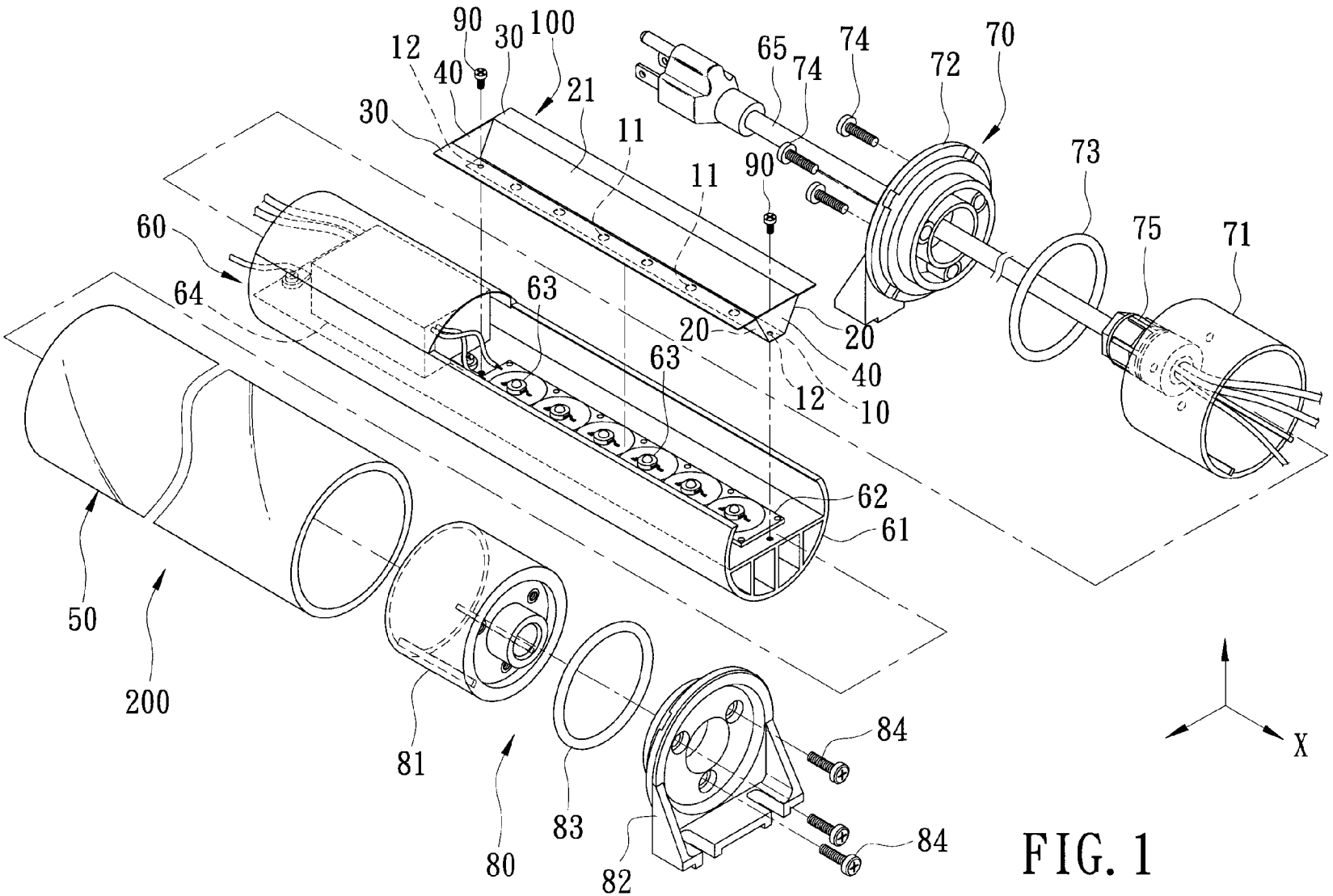
FIG. 1 is an exploded perspective view showing a light emitting diode (LED) lamp that incorporates a first preferred embodiment of a reflector component according to the present invention.

Before the present invention is described in greater detail, it should be noted that like elements are denoted by the same reference numerals throughout the disclosure.

Figure 2:
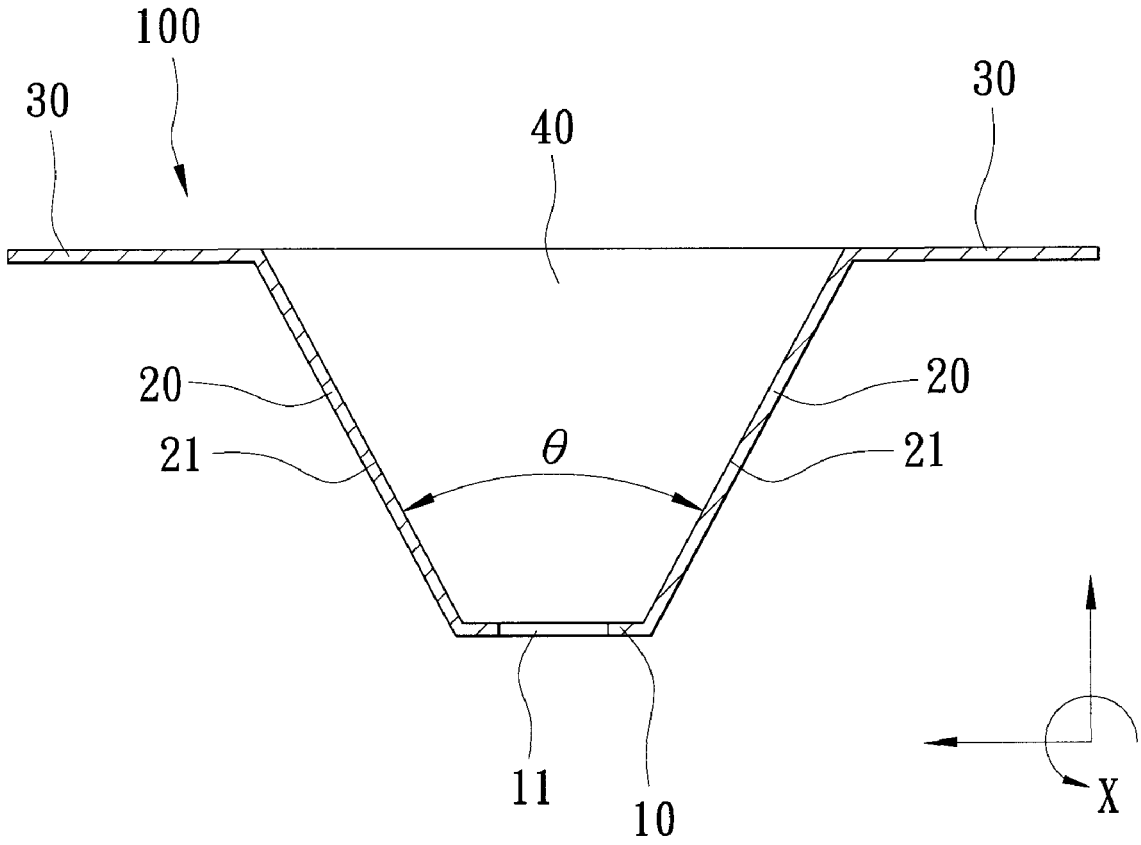
FIG. 2 is a sectional view of the first preferred embodiment according to the present invention.
Figure 3:
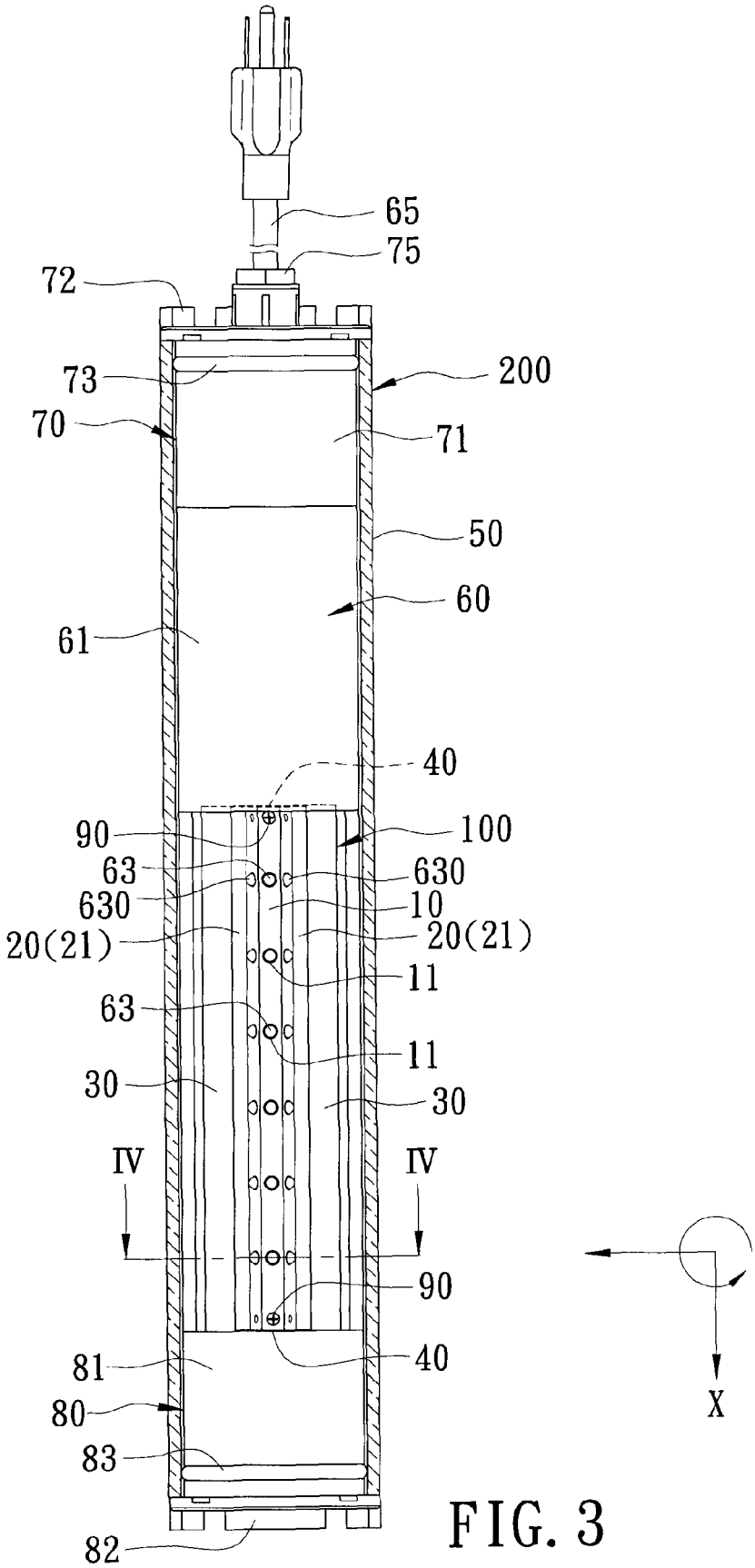
FIG. 3 is a sectional schematic top view of a waterproof lighting fixture including the LED lamp that incorporates the first preferred embodiment.

A first preferred embodiment of a reflector component 100 for a light emitting diode (LED) lamp 60 according to the present invention is shown in FIGS. 1 to 3. In the first preferred embodiment, the LED lamp 60 forms a part of a waterproof lighting fixture 200. The waterproof lighting fixture 200 has a transparent enclosure 50, the LED lamp 60 mounted in the transparent enclosure 50, a first waterproof device 70 and a second waterproof device 80. The transparent enclosure 50 has first and second ends opposite to each other along a longitudinal direction (X). The first waterproof device 70 and the second waterproof device 80 are disposed at a respective one of the first and second ends of the transparent enclosure 50.

The LED lamp 60 includes six LED light sources 63 spaced apart from each other along the longitudinal direction (X). The LED lamp 60 further includes a lamp seat 61, a circuit board 62 disposed on the lamp seat 61, a LED driver 64 electrically connected to the circuit board 62 and disposed on the lamp seat 61, and a power cable 65 electrically connected to the LED driver 64. The LED light sources 63 are mounted on the circuit board 62.

The first waterproof device 70 includes a positioning sleeve 71 mounted in the enclosure 50, an abutment member 72, a first waterproof washer 73 clamped between the positioning sleeve 71 and the abutment member 72, a plurality of screws 74, and a waterproof plug 75 disposed in the positioning sleeve 71 and extending through the abutment member 72. The power cable 65 extends through the abutment member 72, the first waterproof washer 73, the waterproof plug 75, and the positioning sleeve 71.

The second waterproof device 80 includes a positioning sleeve 81 mounted in the enclosure 50, an abutment member 82, a second waterproof washer 83 clamped between the positioning sleeve 81 and the abutment member 82, and a plurality of screws 84. The screws 74, 84 extend through the abutment members 72, 82 and engage the positioning sleeves 71, 81, respectively, thereby pressing the first and second waterproof washers 73, 83 against the enclosure 50. Therefore, the lamp seat 61 is fastened between the positioning sleeves 71, 81.

The reflector component 100 for the LED lamp 60 includes a bottom wall 10, two side walls 20, two end walls 40, and two extension walls 30.

Figure 4:
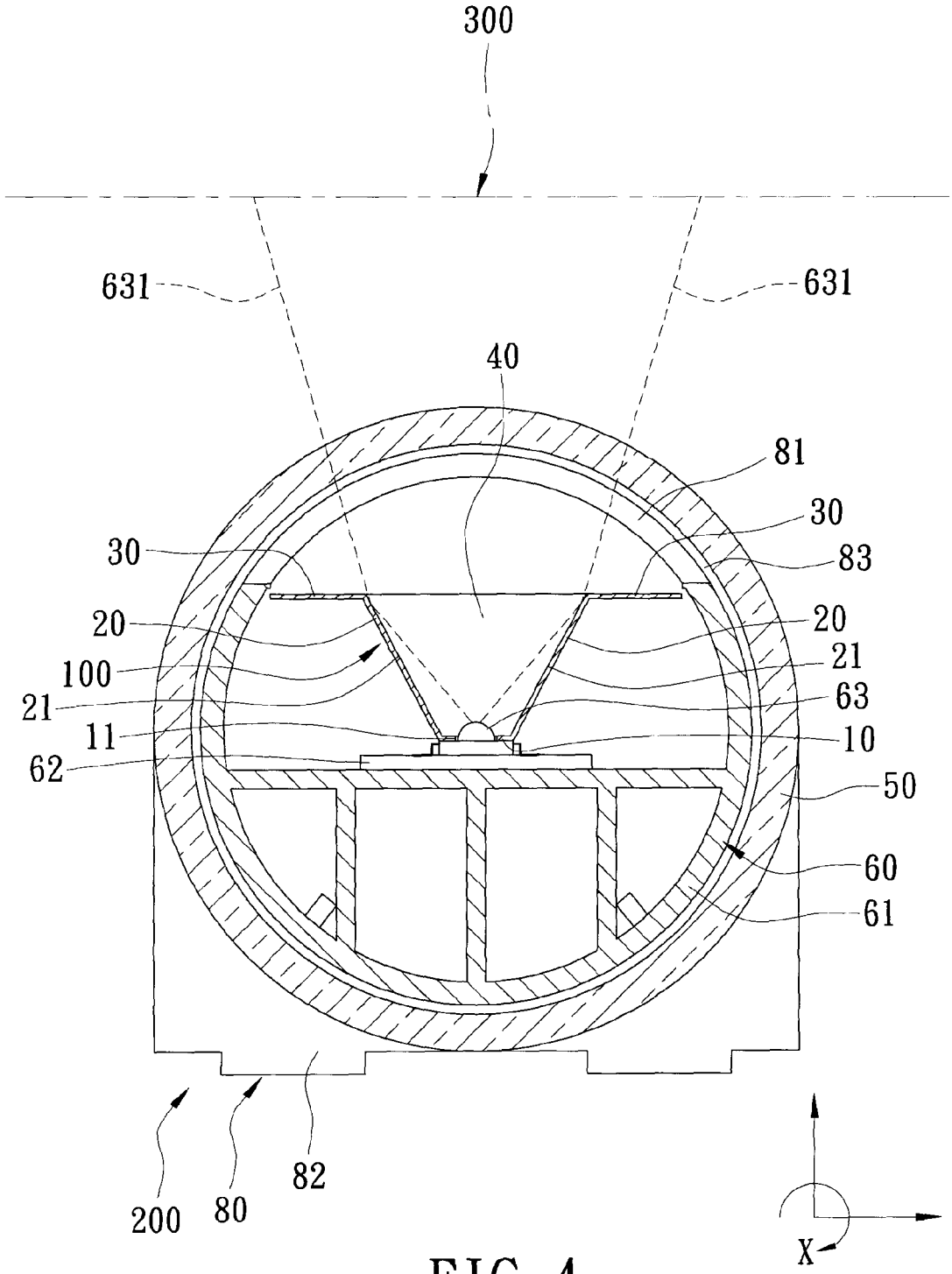
FIG. 4 is a schematic sectional view taken along line IV-IV in FIG. 3.

The bottom wall 10 has two side edges extending along the longitudinal direction (X). The bottom wall 10 is formed with a plurality of through holes 11 that are spaced apart from each other along the longitudinal direction (X). Each of the through holes 11 permits a respective one of the LED light sources 63 to extend therethrough as shown in FIG. 4. The bottom wall 10 is further formed with a pair of fastener holes 12 that are spaced apart from each other along the longitudinal direction (X). The through holes 11 are disposed between the fastener holes 12.

The side walls 20 extend respectively and upwardly from and along the two side edges of the bottom wall 10. Each of the side walls 20 has a reflecting surface 21 that faces toward the other of the side walls 20. The reflecting surfaces 21 of the side walls 20 define an angle θ therebetween that preferably ranges from 80° to 120°. The reflecting surfaces 21 of the sidewalls 20 extend upwardly and inclinedly relative to the bottom wall 10, such that a distance between the reflecting surfaces 21 increases in a direction away from the bottom wall 10.

Each of the bottom wall 10 and the side walls 20 has first and second ends opposite to each other along the longitudinal direction (X). Each of the end walls 40 is connected to the side walls 20 and the bottom wall 10 at a respective one of the first and second ends.

Each of the side walls 20 further has a distal edge opposite to the bottom wall 10. Each of the extension walls 30 of the reflector component 100 extends horizontally from the distal edge of a respective one of the side walls 20 along the longitudinal direction (X) and away from the other one of the side walls 20.

In the first preferred embodiment, the bottom wall 10, the sidewalls 20, the end walls 40, and the extension walls 30 are made of stainless steel.

It should be noted that the bottom wall 10, the side walls 20, the end walls 40, and the extension walls 30 are connected integrally to each other in this embodiment.

As shown in FIGS. 1, 3, and 4, two screws 90 extend through the fastener holes 12 in the bottom wall 10 to secure the reflector component 100 onto the lamp seat 61 of the LED lamp 60 in a manner that the LED light sources 63 on the circuit board 62 extend through the through holes 11, respectively.

When the LED light sources 63 are turned on, six mirror images 630 (see FIG. 3) of the LED light sources 63 are formed by reflection on each of the reflecting surfaces 21 of the side walls 20, i.e., six mirror images 630 of the six LED light sources 63 appear on each of the reflecting surfaces 21. Consequently, a light 631 (see FIG. 4) projected by the LED light sources 63 can provide a projection region 300 (see FIG. 4) that is suitable for large region illumination due to reflection by the reflection surfaces 21.

Figure 5:
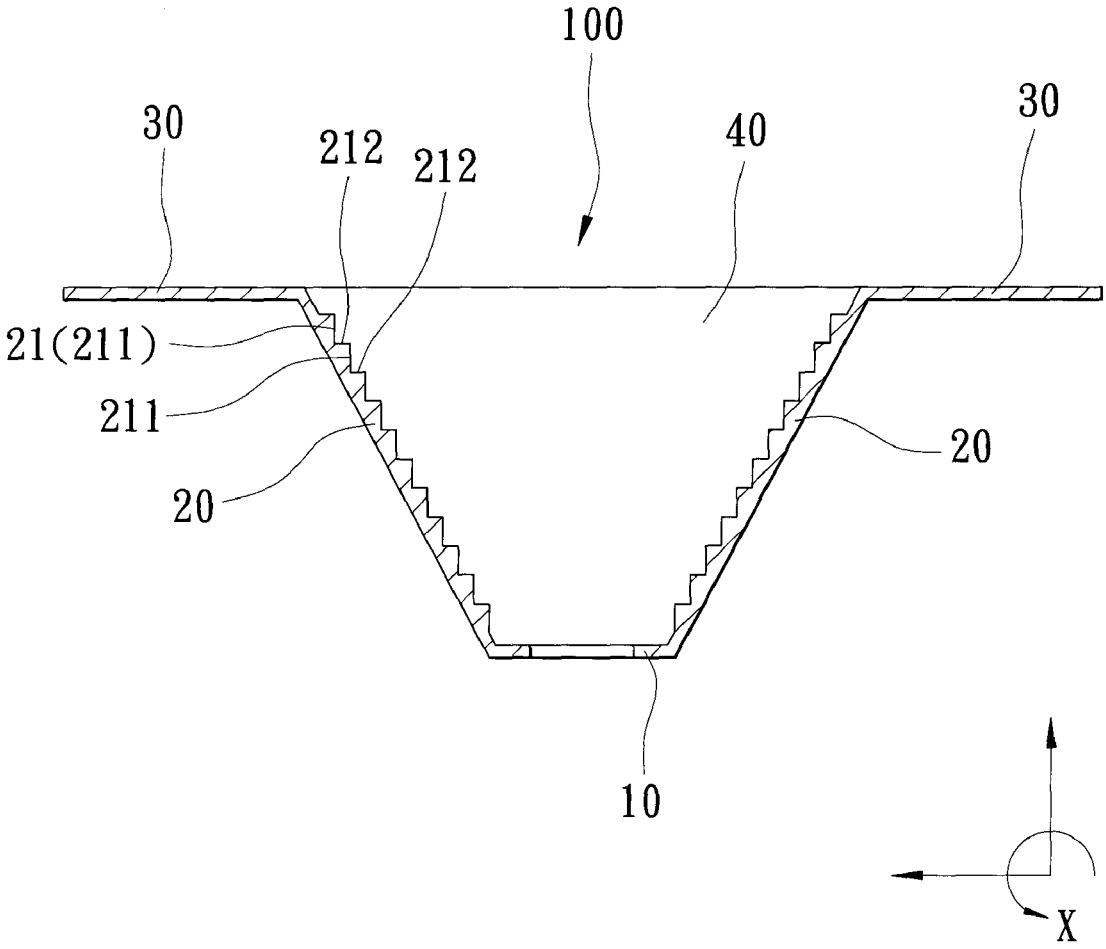
FIG. 5 is a schematic sectional view of a second preferred embodiment of a reflector component for a LED lamp according to the present invention.

As shown in FIG. 5, a second preferred embodiment of the reflector component 100 of the present invention has a structure similar to that of the first preferred embodiment. The main difference between this embodiment and the previous embodiment resides in the configuration of the reflecting surfaces 21 of the side walls 20. In this embodiment, each of the reflecting surfaces 21 of the side walls 20 is formed with a plurality of step portions that extend along the longitudinal direction (X). Each of the step portions includes a vertical face segment 211 and a horizontal face segment 212 transverse to the vertical face segment 211. The second preferred embodiment has the same advantages as those of the first preferred embodiment.

Figure 6:
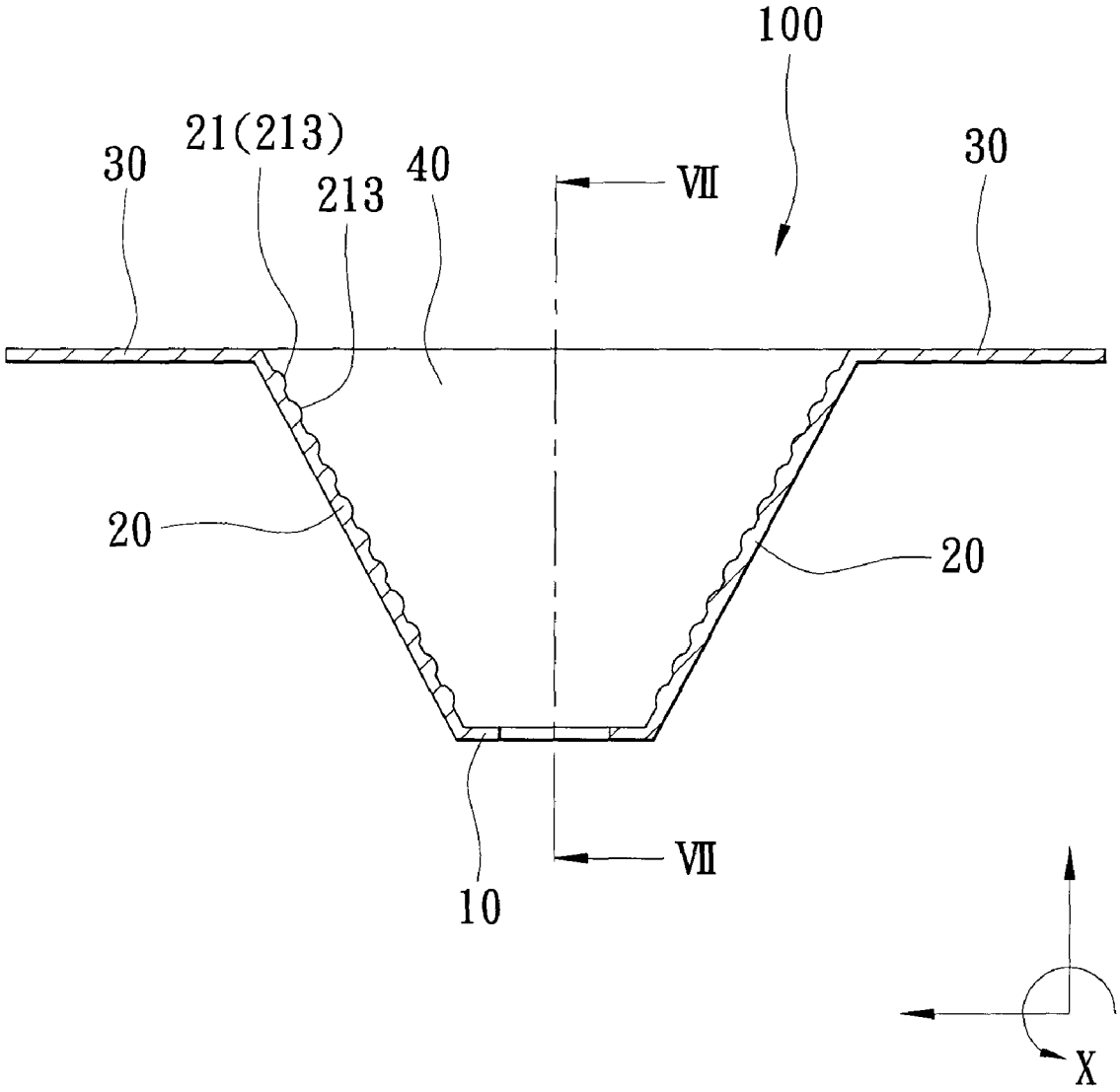
FIG. 6 is a schematic sectional view of a third preferred embodiment of a reflector component for a LED lamp according to the present invention.
Figure 7:
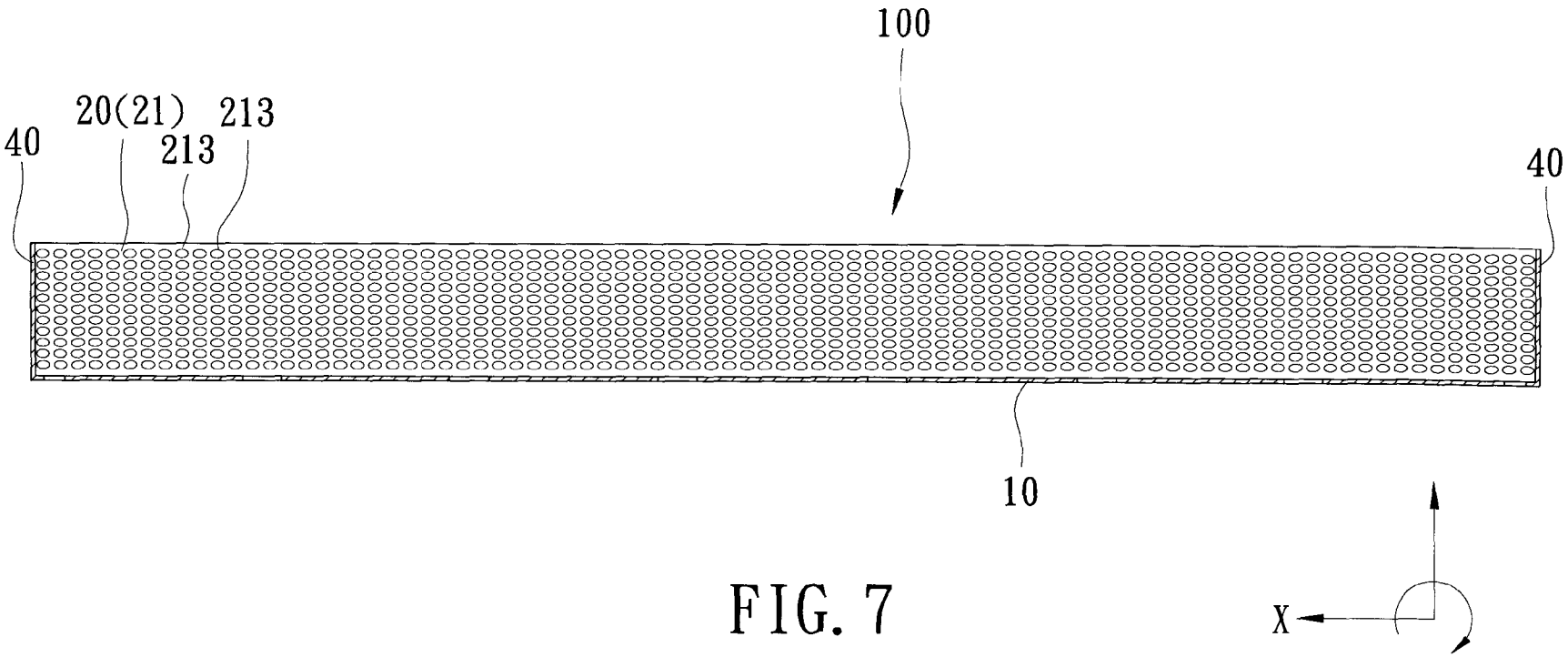
FIG. 7 is a schematic sectional view taken along line VII-VII in FIG. 6.

As shown in FIGS. 6 and 7, a third preferred embodiment of the reflector component 100 according to the present invention has a structure similar to that of the first preferred embodiment. The main difference between the third preferred embodiment and the first preferred embodiment resides in that each of the reflecting surfaces 21 of the sidewalls 20 is formed with a plurality of spaced apart protrusions. The third preferred embodiment has the same advantages as those of the first preferred embodiment, and ensures a softer light output.

Figure 8:
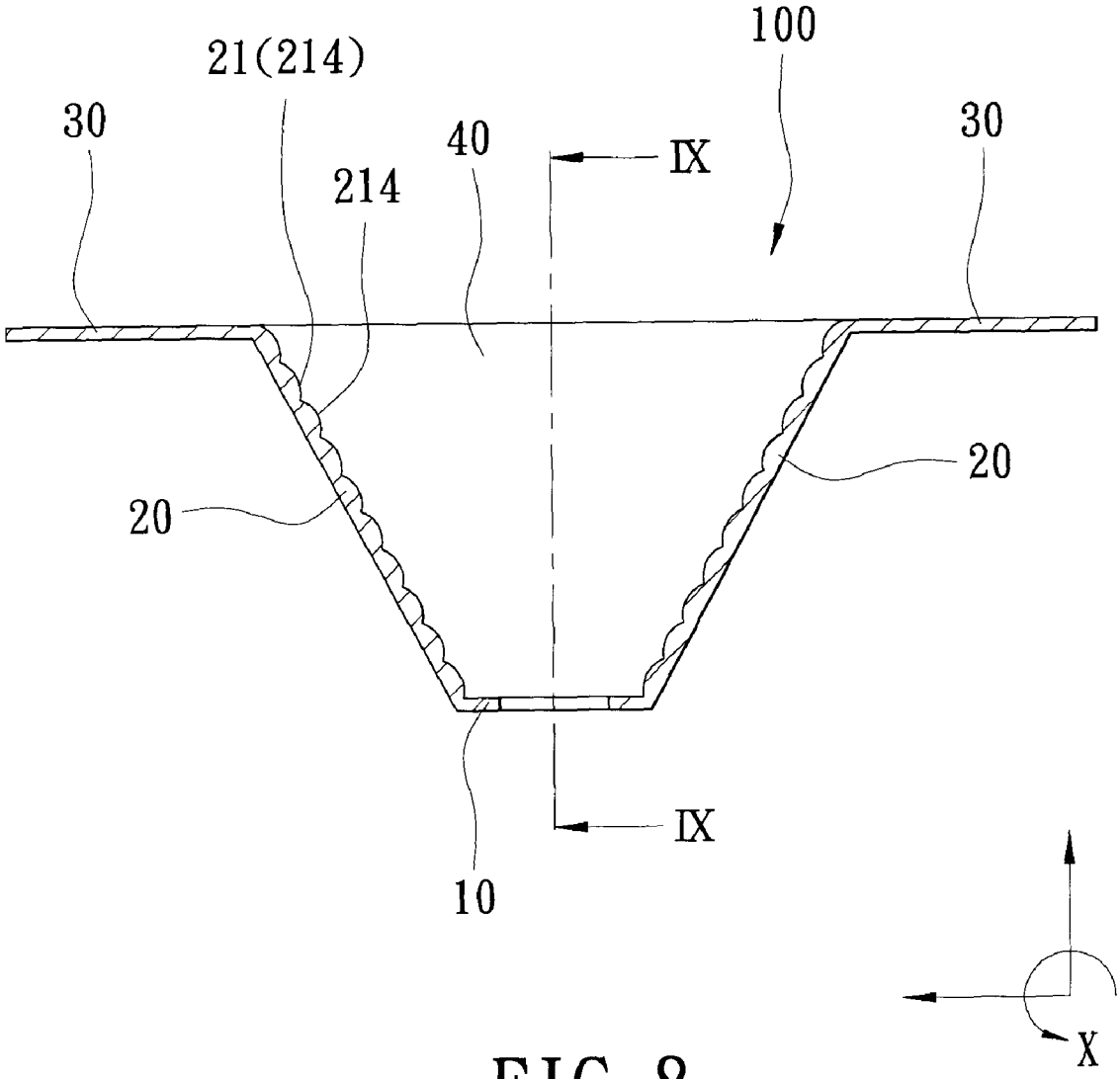
FIG. 8 is a schematic sectional view of a fourth preferred embodiment of a reflector component for a LED lamp according to the present invention.
Figure 9:
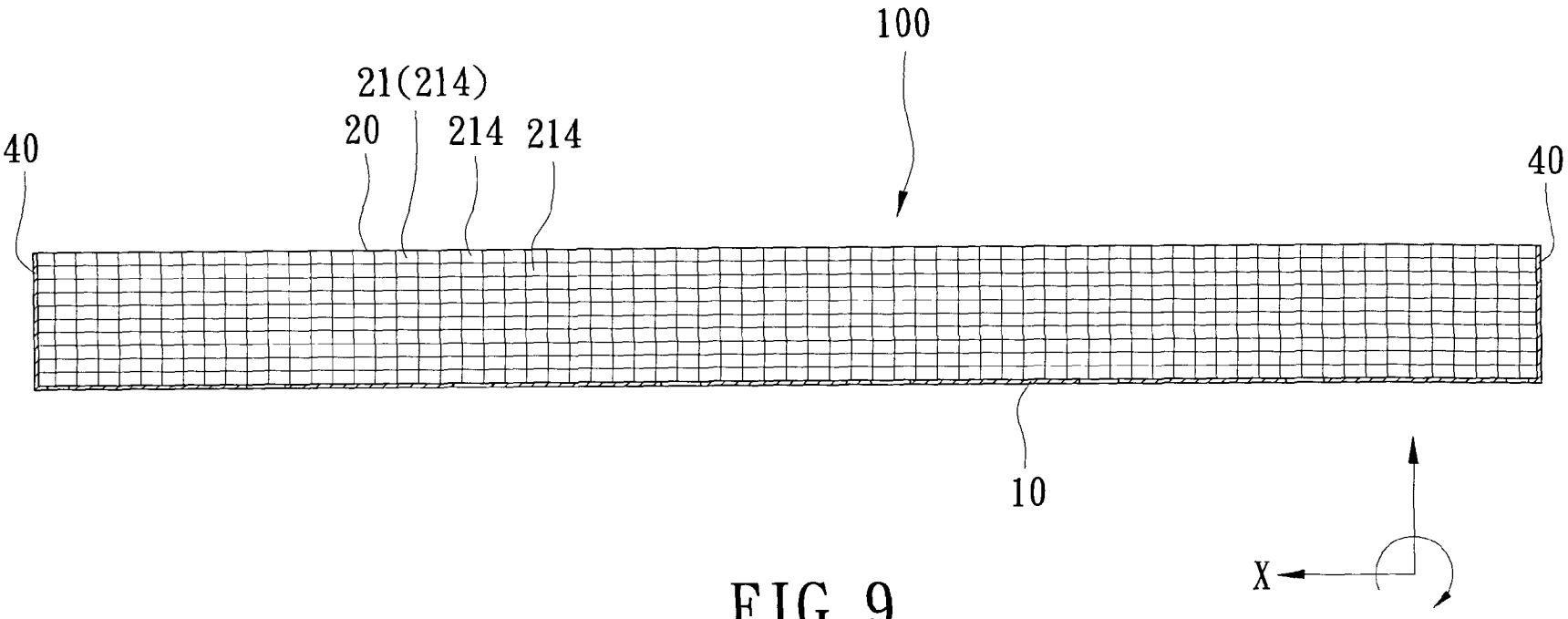
FIG. 9 is a schematic sectional view taken along line IX-IX in FIG. 8.

As shown in FIGS. 8 and 9, a fourth preferred embodiment of the reflector component 100 of the present invention has a structure similar to that of the first preferred embodiment. The main difference between the fourth preferred embodiment and the first preferred embodiment resides in that each of the reflecting surfaces 21 of the side walls 20 has a lattice configuration, i.e., each of the reflecting surfaces 21 is formed with an array of rectangular reflecting parts 214. The fourth preferred embodiment has the same advantages as those of the first preferred embodiment.

Figure 10:
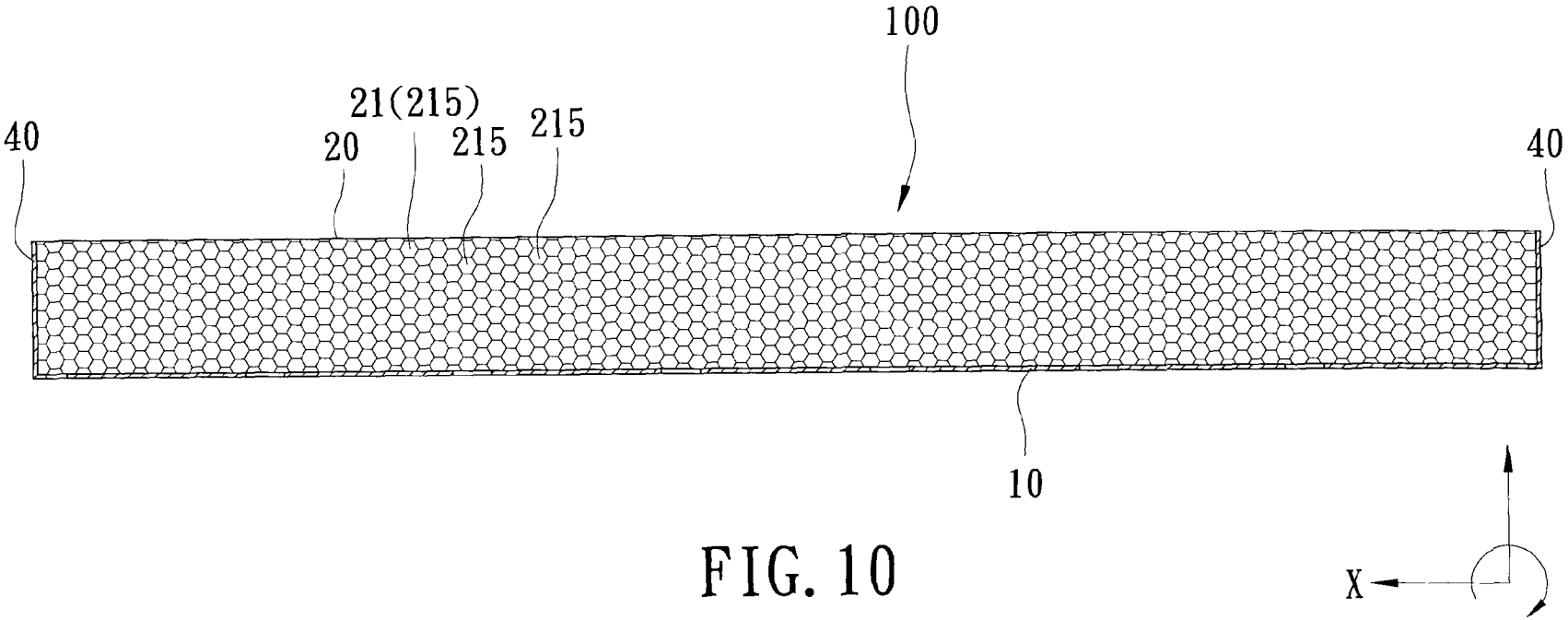
FIG. 10 is a schematic sectional view of a fifth preferred embodiment of a reflector component for a LED lamp according to the present invention.

As shown in FIG. 10, a fifth preferred embodiment of the reflector component 100 according to the present invention has a structure similar to that of the fourth preferred embodiment. The main difference between this embodiment and the fourth preferred embodiment resides in that each of the reflecting surfaces 21 of the side walls 20 has a honeycomb configuration, i.e., each of the reflecting surfaces 21 is formed with a pattern of hexagonal reflecting parts 215. The fifth preferred embodiment has the same advantages as those of the first preferred embodiment.

Figure 11:
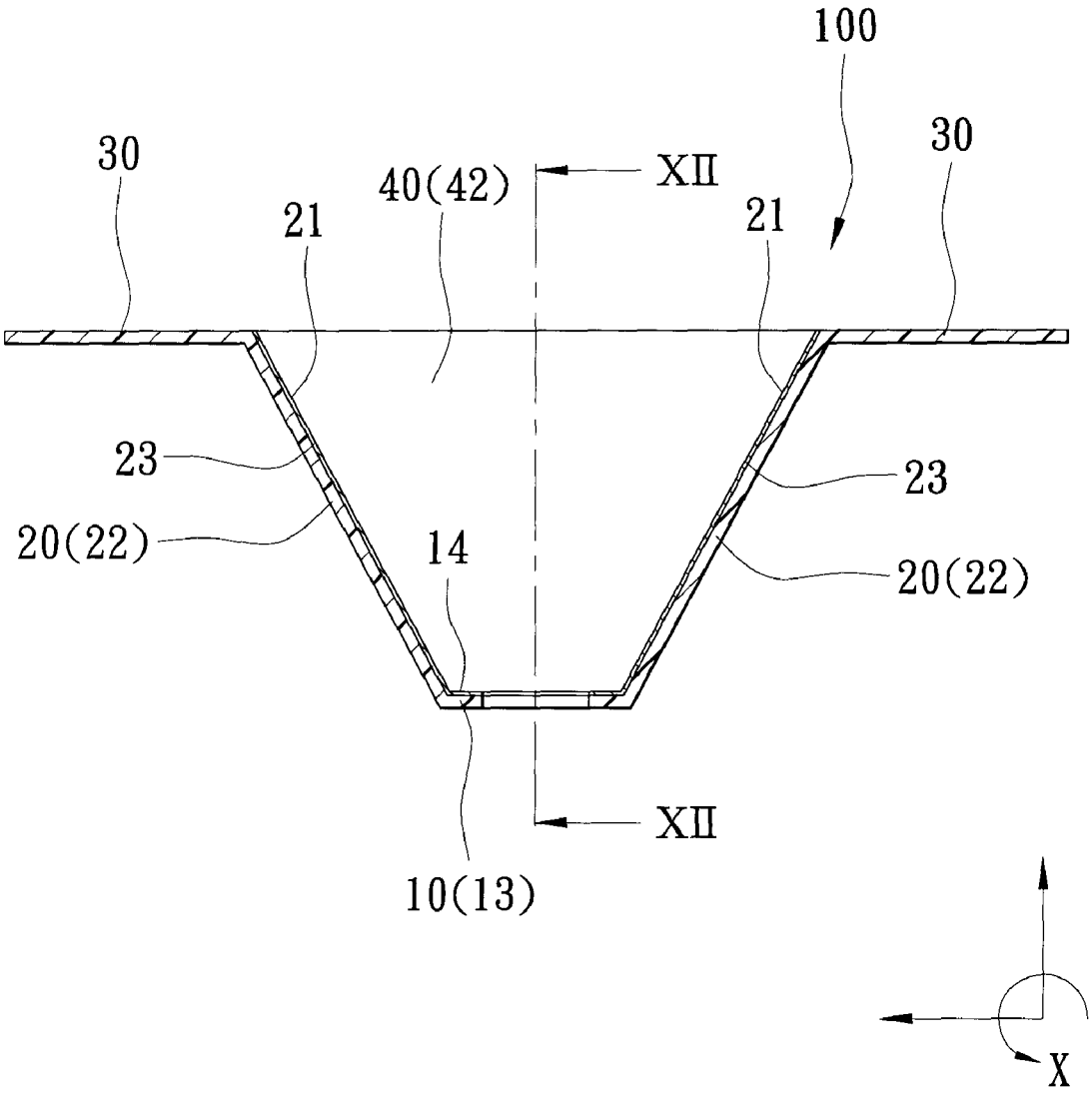
FIG. 11 is a schematic sectional view of a sixth preferred embodiment of a reflector component for a LED lamp according to the present invention.
Figure 12:
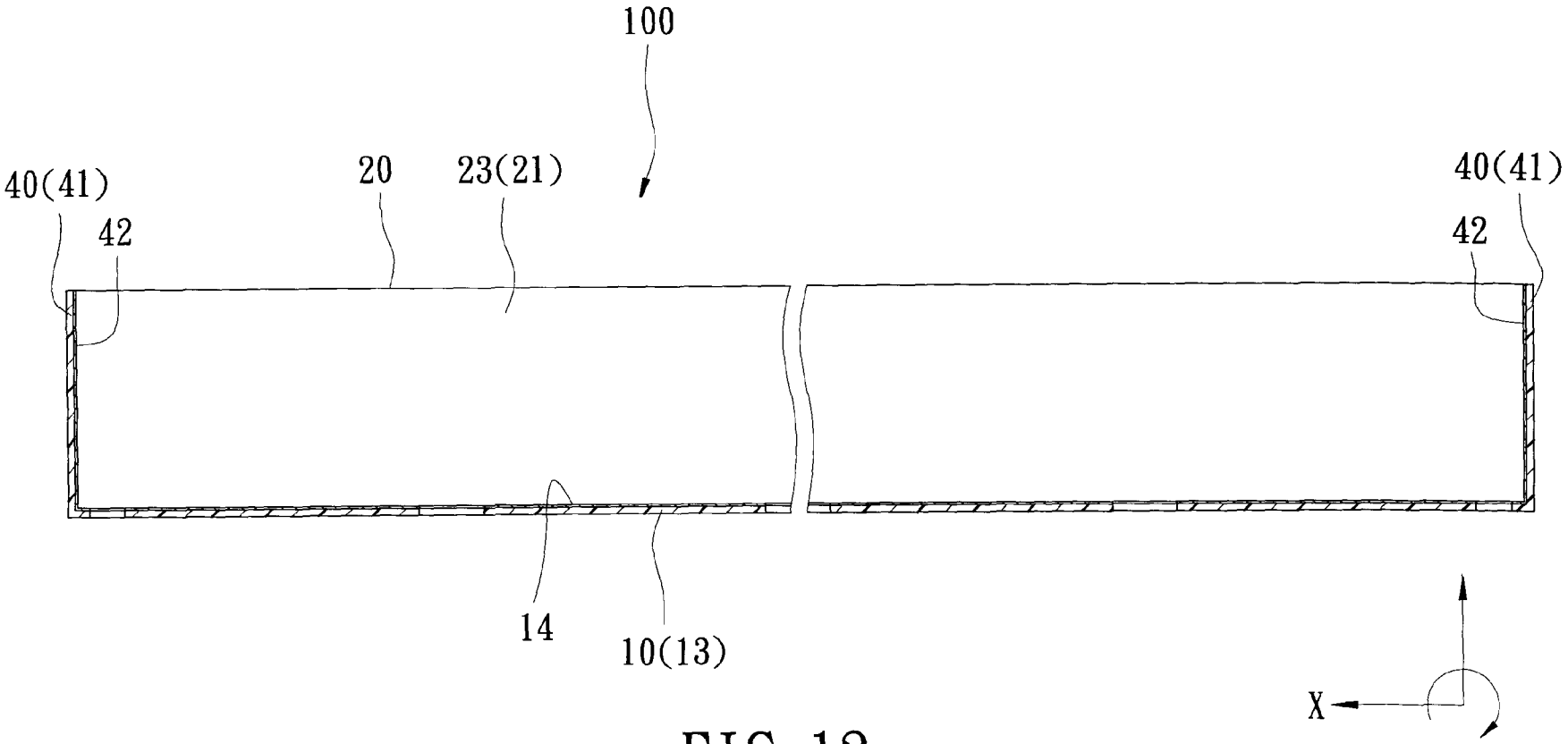
FIG. 12 is a schematic sectional view taken along line XII-XII in FIG. 11.

As shown in FIGS. 11 and 12, the sixth preferred embodiment of the reflector component 100 of the present invention has a structure similar to that of the first preferred embodiment. The main difference between this embodiment and the first preferred embodiment resides in the following. Each of the side walls 20 includes a wall body 22 and an electroplated layer 23 formed on the wall body 22 and having the reflecting surface 21. The bottom wall 10 includes a wall body 13 and an electroplated layer 14 formed on the wall body 13 of the bottom wall 10. Each of the end walls 40 includes a wall body 41 and an electroplated layer 42 formed on the wall body 41 of the end wall 40.

The wall bodies 22, 13, 41 of the side walls 20, the bottom wall 10, and the end walls 40, as well as the extension walls 30, are integrally formed from plastic. The electroplated layers 23, 14, 42 of the side walls 20, the bottom wall 10, and the end walls 40 are integrally formed by vacuum electroplating on the side walls 20, the bottom wall 10, and the end walls 40 with the use of metal material. The sixth preferred embodiment has the same advantages as those of the first preferred embodiment.

To sum up, the reflector component 100 of the present invention provides a large projection region and even illumination intensity when used with the LED lamp 60.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A reflector component for a light emitting diode (LED) lamp, the LED lamp including a plurality of LED light sources spaced apart from each other along a longitudinal direction, said reflector component comprising:

a bottom wall having two side edges that extend along the longitudinal direction, said bottom wall being formed with a plurality of through holes that are spaced apart from each other along the longitudinal direction, each of said through holes permitting a respective one of the LED light sources to extend therethrough;

two side walls extending respectively and upwardly from and along said two side edges of said bottom wall, each of said side walls having a reflecting surface that faces toward the other of said side walls, said reflecting surfaces of said side walls extending upwardly and inclinedly relative to said bottom wall such that a distance between said reflecting surfaces increases in a direction away from said bottom wall, each of said side walls having a distal edge opposite to said bottom wall; and two extension walls each extending horizontally from said distal edge of a respective one of said side walls along the longitudinal direction and away from the other one of said side walls.

2. The reflector component as claimed in claim 1, wherein said reflecting surfaces of said side walls define an angle therebetween that ranges from 80° to 120°.

3. The reflector component as claimed in claim 1, wherein each of said reflecting surfaces of said side walls is formed with a plurality of step portions that extend along the longitudinal direction.

4. The reflector component as claimed in claim 3, wherein each of said step portions includes a vertical face segment and a horizontal face segment transverse to said vertical face segment.

5. The reflector component as claimed in claim 1, wherein each of said reflecting surfaces of said side walls is formed with a plurality of spaced-apart protrusions.

6. The reflector component as claimed in claim 1, wherein each of said reflecting surfaces of said side walls has a lattice configuration.

7. The reflector component as claimed in claim 1, wherein each of said reflecting surfaces of said side walls has a honeycomb configuration.

8. The reflector component as claimed in claim 1, wherein said bottom wall is further formed with a pair of fastener holes that are spaced apart from each other along the longitudinal direction, said through holes being disposed between said fastener holes.

9. The reflector component as claimed in claim 1, wherein each of said side walls and said bottom wall has first and second ends opposite to each other along the longitudinal direction, said reflector component further comprising two end walls connected to said side walls and said bottom wall at a respective one of said first and second ends.

10. The reflector component as claimed in claim 9, wherein said bottom wall, said side walls, said end walls, and said extension walls are made of stainless steel.

11. The reflector component as claimed in claim 1, wherein each of said side walls includes a wall body and an electroplated layer formed on said wall body and having said reflecting surface.

12. The reflector component as claimed in claim 11, wherein said bottom wall includes a wall body and an electroplated layer formed on said wall body of said bottom wall.

13. The reflector component as claimed in claim 12, wherein each of said side walls and said bottom wall has first and second ends opposite to each other along the longitudinal direction, said reflector component further comprising two end walls connected to said side walls and said bottom wall at a respective one of said first and second ends, each of said end walls including a wall body and an electroplated layer formed on said wall body of said end wall.

14. The reflector component as claimed in claim 13, wherein:

said wall body of each of said side walls, said bottom wall, and said end walls is made of plastic; and said electroplated layer of each of said side walls, said bottom wall, and said end walls is made of metal.

15. A light emitting diode (LED) lamp comprising:

a plurality of LED light sources spaced apart from each other along a longitudinal direction; and a reflector component including:

a bottom wall having two side edges that extend along the longitudinal direction, said bottom wall being formed with a plurality of through holes that are spaced apart from each other along the longitudinal direction, each of said through holes permitting a respective one of said LED light sources to extend therethrough;

two side walls extending respectively and upwardly from and along said two side edges of said bottom wall, each of said side walls having a reflecting surface that faces toward the other of said side walls, said reflecting surfaces of said side walls extending upwardly and inclinedly relative to said bottom wall such that a distance between said reflecting surfaces increases in a direction away from said bottom wall, each of said side walls having a distal edge opposite to said bottom wall; and two extension walls each extending horizontally from said distal edge of a respective one of said side walls along the longitudinal direction and away from the other one of said side walls.

* * * * *